United States Patent [19]

Marostica et al.

[11] 3,933,261

[45] Jan. 20, 1976

[54] CONSTRUCTION EQUIPMENT

[75] Inventors: Jerome L. Marostica; William L. McLaughlin, both of Anchorage, Alaska

[73] Assignee: BHB Corporation, Anchorage, Alaska

[22] Filed: Apr. 16, 1974

[21] Appl. No.: 461,455

[52] U.S. Cl. ..... 214/138 R; 214/3

[51] Int. Cl.[2] ..... B66F 9/00

[58] Field of Search ..... 214/138 R, 138 C, 130 R, 214/92, 90 R, 3; 37/184

[56] References Cited

UNITED STATES PATENTS

| | | | |
|---|---|---|---|
| 2,814,396 | 11/1957 | Neale, Sr. | 214/3 |
| 3,071,405 | 1/1963 | Koehler | 214/3 |
| 3,286,855 | 11/1966 | Bill | 214/3 |
| 3,288,316 | 11/1966 | West | 214/145 |
| 3,524,560 | 8/1970 | Hall | 214/138 R |
| 3,606,048 | 9/1971 | Long | 214/140 |
| 3,628,675 | 12/1971 | Balogh | 214/3 |

FOREIGN PATENTS OR APPLICATIONS

| | | | |
|---|---|---|---|
| 839,925 | 7/1949 | Germany | 214/138 R |

*Primary Examiner*—Leo Friaglia
*Assistant Examiner*—David M. Mitchell
*Attorney, Agent, or Firm*—Spencer & Kaye

[57] ABSTRACT

A construction machine composed of a backhoe on a tractor vehicle equipped with a high strength cab, the machine further including a boom assembly mounted atop the cab for pivotal movement about a vertical axis and a horizontal axis. The boom can be equipped with a suitable tool to cooperate with the backhoe. The boom preferably carries a pole claw and a cable equipped with a chain and hook for erecting a pole, while the backhoe can perform the attendant digging and refilling of the trench.

7 Claims, 8 Drawing Figures

CONSTRUCTION EQUIPMENT

BACKGROUND OF THE INVENTION

The present invention relates to construction equipment, and particularly to construction machines constituted by self-propelled vehicles equipped with a backhoe.

A backhoe mounted on a tracked or wheeled tractor constitutes a versatile piece of field equipment which can travel over a wide variety of terrain and efficiently perform digging operations. Therefore, such machines are currently used in a wide variety of construction projects.

It is not uncommon for a backhoe to be mounted on the rear of a tractor which is also equipped with a front-end loader unit. Such machines can selectively perform earth moving and digging operations.

While such machines have a wide variety of uses, there are many operations which they cannot perform alone. In these cases, it is therefore necessary for a number of machines to travel to the job site. This, of course, increases the cost of the operation, not only because of the higher capital expenditures for a number of vehicles and higher fuel and maintenance costs, but also because at least one operator must be provided for each vehicle.

In addition, the necessity for the vehicles to be properly positioned relative to one another at the job location in order to cooperate in the manner required by the operation to be performed creates additional problems, particularly when the operation is to be performed in difficult terrain where there might not be a large enough ground area which is sufficiently level and solid to support a number of machines in close proximity to one another.

One commonly encountered operation which involves use of a backhoe but which cannot be performed by currently available backhoe machines alone involves the installation of power and telephone poles. Currently, to do this job, a backhoe machine of the type described above is driven to the job location together with any one of a variety of machines equipped with members capable of lifting the pole and maintaining it vertical in a trench while the trench is being backfilled by a backhoe, and possibly subsequently tamped.

SUMMARY OF THE INVENTION

It is an object of the present invention to reduce the cost and difficulty of performing operations of the above-described type.

Another object of the invention is to reduce the amount of equipment and the number of operators required for performing such tasks.

These and other objects according to the invention are achieved by providing a backhoe-equipped tractor with a cab which encloses the operator location and which has a high load supporting capability, and with a boom assembly mounted atop the cab for pivotal movement about a vertical axis and horizontal axes, the boom being equipped with a suitable tool to cooperate with the backhoe.

In further accordance with the invention, the controls for operating the boom and its associated tool are located within the cab, as are the controls for operating the backhoe and for driving the tractor.

According to preferred embodiments of the invention, the boom carries a pole claw and a cable equipped with a chain and hook for erecting a pole and these devices on the boom can cooperate with the backhoe in such a manner as to enable the single machine to perform all of the operations attendant to the erection of a power line pole or telephone pole, these including digging the required hole, erecting the pole in the hole in a perfectly vertical orientation, and backfilling the hole while the pole is held stationary in such vertical orientation. This machine can also be used to advantage for installing other structures such as street light standards, advertising signs, traffic light standards, etc.

A machine according to the invention equipped with a front-end loader as well as a backhoe and a boom carrying a pole claw and a cable provided at its end with a chain and hook is particularly well suited for the installation of power line and telephone poles in locations where installation requires the use of select backfill material.

For example, if such a pole is to be installed on wet or swampy land, it may be required that the material used to fill the trench after the pole has been positioned be different from that available at the installation site. In this case, the front-end loader bucket can be filled with the required backfill material before the machine is driven to the installation site. Once at the site, the select backfill material can be dropped to one side of the pole erection point. Then, the required hole, or trench, will be dug by the backhoe. Subsequently, the chain and hook at the end of the cable are lowered and placed around the pole at a point between its center of gravity and top. The cable is then lifted to bring the pole into a raised orientation, whereupon the pole can be gripped by the pole claw and maneuvered into the trench. Once the pole has been plumbed, it can continue to be held in such vertical orientation by the pole claw while the backhoe bucket is operated to fill the hole with the select backfill material.

It might also be mentioned that one significant advantage of the mounting of a backhoe and a boom on a single vehicle is that it offers the possibility of lowering the outriggers and bucket of the backhoe into firm contact with the ground so as to constitute a three-point support which effectively stabilizes the machine while the boom and its associated pole claw or other tool are being employed to lift and position a pole or other load. This not only facilitates the lifting and placing of heavy loads by means of the boom, but provides a high degree of safety both for the machine and personnel in the vicinity of the work, particularly when such load is located above the triangular area defined by the three support points. Of course, this three-point support can be achieved with the backhoe pivoted horizontally away from its center position to enable the tool at the end of the boom to manipulate loads directly behind the machine.

In machines according to the invention equipped with a special cab and a boom mounted on the cab, the overall assembly will present a low profile when the boom is fully retracted. As a result, the machine will retain a low center of gravity, i.e. will not be top-heavy, while travelling. It has been found that the additional weight of the boom and the special cab has very little effect on the mobility of the vehicle which, in the case of a tractor-type vehicle, retains its ability to travel into and across rought and/or wet terrain, even when it is hauling a pole and its associated hardware, while carrying the load of backfill material in the bucket of its front-end loader.

DESCRIPTION OF THE PREFERRED EMBODIMENTS

Figure 1:
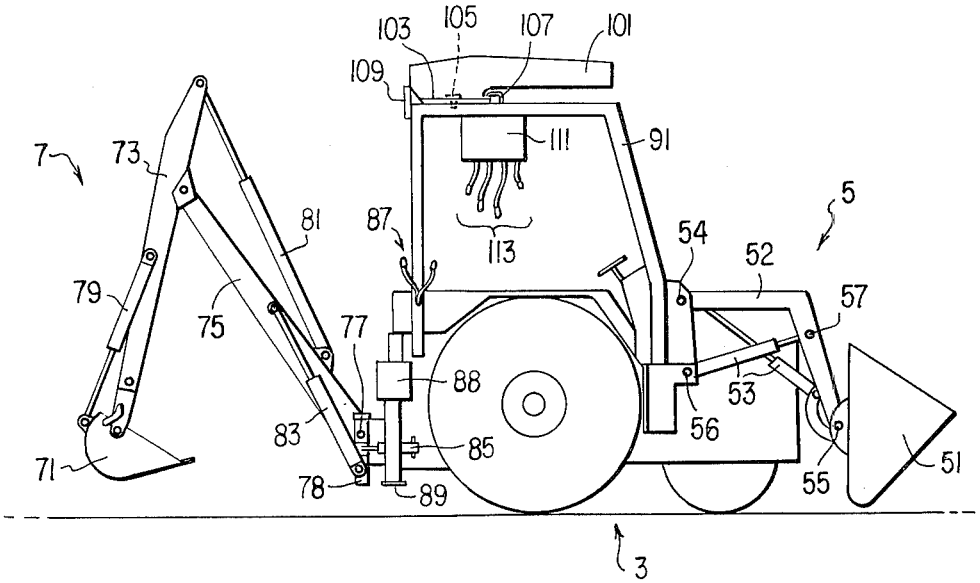
FIG. 1 is an elevational side view of one embodiment of a machine incorporating the present invention.

FIG. 1 illustrates the general arrangement of one type of field equipment which can be constructed according to the invention. the piece of equipment is composed of a wheeled tractor 3 equipped at its front end with a front-end loader 5 and it its read end with a hydraulic backhoe 7. Wheeled tractors having an open operator's location, that is without any enclosing cab, or with a lightweight cab, and provided with a front-end loader and a backhoe arranged in the manner illustrated in FIG. 1 are already known in the art and are presently being used in the field.

Both the front-end loader 5 and the backhoe 7 may be of any known construction. The front-end loader essentially includes a wide hydraulically operated bucket 51 mounted on jointed arms 52, with the movement of the arms and the bucket being controlled by suitable hydraulic pistons 53. Arms 52 are pivotally mounted to the tractor at pivots 54 and to the bucket at pivots 55, while pistons 53 are pivotally mounted to the tractor at pivots 56 and to the arms 52 at pivots 57.

In operation, the bucket of the front-end loader is filled by the forward motion of tractor 3, while the bucket is raised and emptied by the action of the hydraulic pistons.

Backhoe 7 is composed essentially of an inverted bucket 71 mounted at the end of a stick 73 pivotally supported, at an intermediate point along its length, by the free end of a boom 75. Boom 75 is supported at its other end on a pivot shaft 77 presenting a horizontal pivot axis and supported in a member 78 mounted to the tractor to be capable of pivotal movement about a vertical axis.

Pivotal movement between bucket 71 and stick 73 is controlled by a hydraulic piston 79, while pivotal movement between stick 73 and boom 75 is controlled by a hydraulic piston 81 and pivotal movement between boom 75 and member 78 is controlled by a hydraulic piston 83. The movement produced by each of pistons 79, 81 and 83 is about a respective horizontal axis. Pivoting of member 78, and the entire backhoe asembly 7, about a vertical axis is effected by operation of a double-acting hydraulic piston 85 pivotally connected between member 78 and the tractor.

All of the hydraulic pistons are connected, by suitable hydraulic lines (not shown), to a source of pressure fluid and the selective delivery of pressure fluid to each end of the cylinder of each piston is effectuated by the operation of manual controls 87. Two such controls are illustrated in FIG. 1 and each of these is preferably of the four-way type, i.e. each control lever can be moved along either one of two mutually perpendicular paths, with movement of a lever in either direction along one path controlling the extension or retraction of the piston of one cylinder and movement in either direction along the other path controlling the extension or retraction of the piston of a different cylinder. Such controls are abundantly well known in the art and are currently employed in a variety of commercially available machines.

Backhoe 7 is also equipped, in a known manner, with a pair of outriggers 88 which can be manually pivoted about the horizontal axes defined by pivot pins 89 into a stabiliziing position in contact with the ground.

Figure 2:
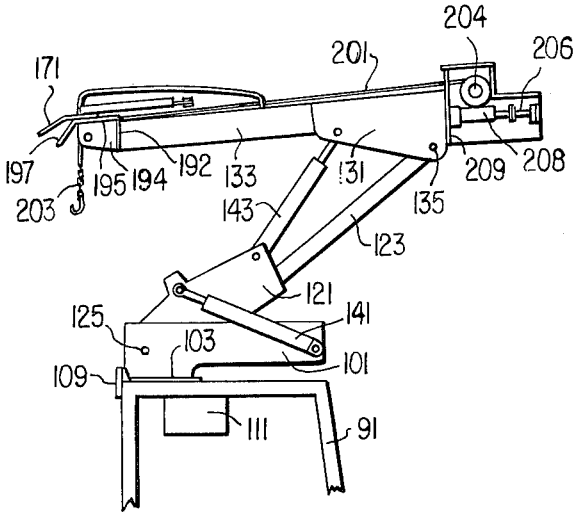
FIG. 2 is a view similar to that of FIG. 1 of one embodiment of the invention as mounted on the machine of FIG. 1.

In accordance with the present invention, the tractor 3 is equipped with a special cab 91 enclosing the operator's work and driving locations and designed to support high level weight loads.

mounted atop cab 91 is an extensible boom, whose overall arrangement is illustrated in FIG. 2. The portion of the boom shown in FIG. 1 includes a boom housing 101 mounted on, and rigidly fixed to, a turntable 103 which rests atop cab 91 and which is mounted to the cab by a pivot pin 105 defining a vertical pivot axis. Also mounted atop the cab is one or more rollers 107 which bear against the upper surface of turntable 103 to oppose any tilting of the turntable when the free end of the boom is supporting a load.

Also affixed to the top of the cab are two stationary abutment members 109 which will be described in greater detail below and which provide the support points for the forces applied to effect pivoting of the boom about the axis defined by pin 105. One abutment member 109 is disposed adjacent each side of cab 91.

Extending downwardly from the roof of cab 91, into the operator's work location, is a control console 111 carrying a plurality of hydraulic control levers used to control the operation of the boom.

The general arrangement of the boom assembly mounted on, and supported by, boom housing 101 is shown in FIG. 2. This assembly includes a lower boom constituted by a pair of structural plates 121 and a box member 123 rigidly fastened between plates 121. At the end remote from the point of connection to box member 123, plates 121 are interconnected by a strengthening member, which can be a hollow tube, and are pivotally connected to housing 101 by means of pivot pins 125 defining a horizontal axis about which the boom assembly can be pivoted.

The upper boom of the boom assembly is constituted by a pair of structural plates 131 and a box member 133 rigidly connected at one end between plates 131. The outer end of box member 123 of the lower boom extends into the space between plates 131 and is connected thereto by pivot pins 135 which define a horizontal axis about which the upper boom can pivot relative to the lower boom.

The boom assembly relative to housing 101 about the pivot axis of pins 125 is controlled by a pair of hydraulic pistons 141 each disposed at a respective side of the assembly, each piston being pivotally connected between housing 101 and a respective one of the plates 121. Similarly, rotation of the upper boom relative to the lower boom about the axis defined by pins 135 is controlled by a hydraulic piston 143 pivotally connected between plates 121 and plates 131.

Pistons 141 and 143, as well as all of the other hydraulic pistons associated with the boom assembly are supplied with hydraulic pressure fluid via flexible conduits (not shown) under the control of valves of a standard type located in console 111 and controlled by levers 113, which are also preferably of the four-way type. Valve and lever arrangements for this purpose are abundantly well-known in the art and commercially available in the industry.

Figure 3:
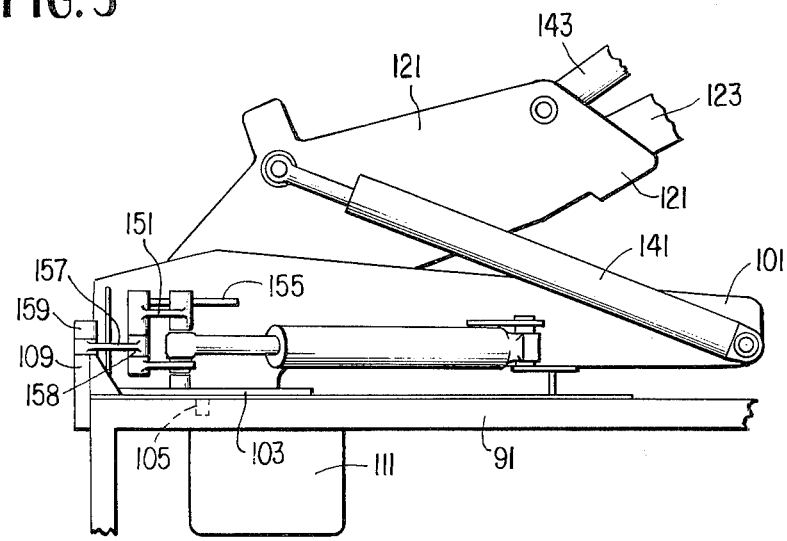
FIG. 3 is an elevational detail view of a portion of the arrangement shown in FIG. 2.
Figure 4:
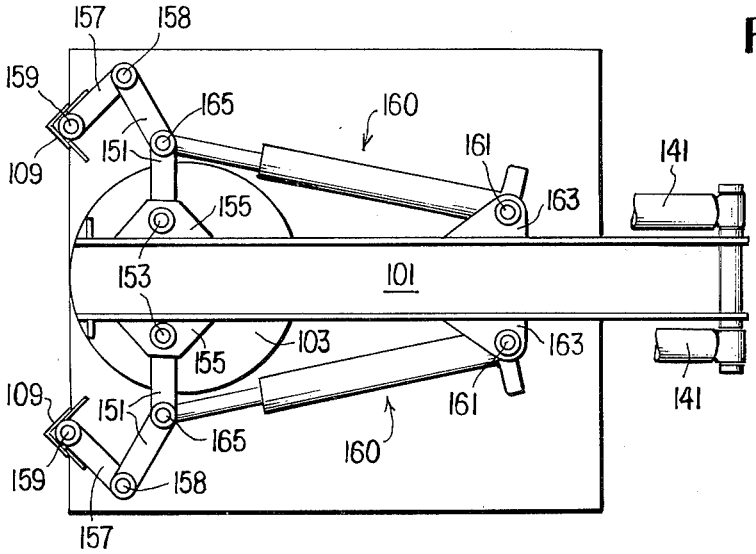
FIG. 4 is a top plan, detail view of the portion of the embodiment shown in FIG. 3 in a first operating position.
Figure 5:
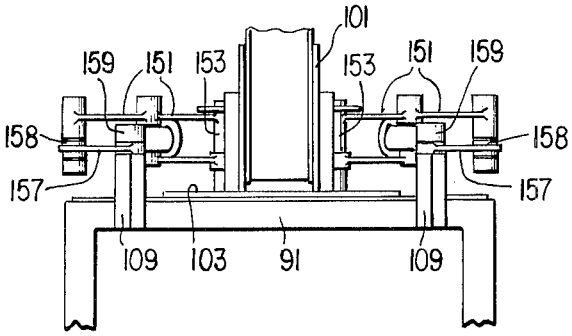
FIG. 5 is a front elevational view of the portion of the structure shown in FIGS. 3 and 4.

The mechanism for rotating turntable 103 and housing 101, together with the entire boom assembly, about the vertical axis defined by pivot pin 105 (FIG. 1) is shown in detail in FIGS. 3–5.

This mechanism includes two identical linkages each connected at a respective side of boom housing 101 and each operatively associated with a respective one of the stationary abutment members 109. Each such linkage is constituted by a two-arm crank member 151 having one end pivotally connected to a pivot pin 153 supported by a flange 155 mounted on housing 101. Each linkage further includes an arm 157 pivotally connected to the other end of crank member 151 by means of a pivot pin 158. Each crank member 157 carries at its other end a roller 159 engaging in a respective abutment member 109 which is constituted by a vertically oriented angle iron.

The described linkage is operated by hydraulic pistons 160 pivotally connected between pivot pin 161 supported by flanges 163 attached to boom housing 101 and pivot pins 165 each connected to the midpoint of a respective one of crank members 151.

To pivot the boom assembly about the vertical axis defined by pin 105, pressure fluid is supplied to the cylinder of either one of pistons 160 to extend the associated piston. The other hydraulic piston, not being supplied with hydraulic pressure fluid, is permitted to retract. The extension of one of the pistons 160, accompanied by the retraction of the other piston, and the resulting action of the linkage constituted essentially by arms 151 and 157 causes the boom assembly to pivot in one direction or the other. The valves associated with the pressure fluid conduits connected to pistons 160 can, in a well-known manner, be constructed so that the fluid present in the piston undergoing retraction can drain off through a pressure relief valve. However, the fluid remaining in that piston is made to exert sufficient back pressure to retain the roller 159 of its associated linkage in abutting engagement with the associated abutment member 109.

Figure 6:
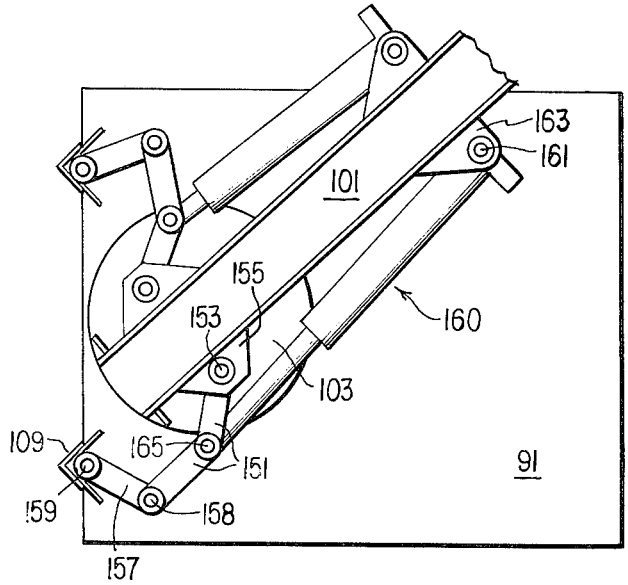
FIG. 6 is a view similar to that of FIG. 4 showing the illustrated components in a second operating position.

FIG. 6 shows the boom pivoted counterclockwise from its center position as a result of pressure fluid having been supplied to one of the pistons 160. The illustrated mechanism is capable of pivotinig the boom through an angle of the order of 140°, i.e. 70° to each side of its center position.

Figure 7:
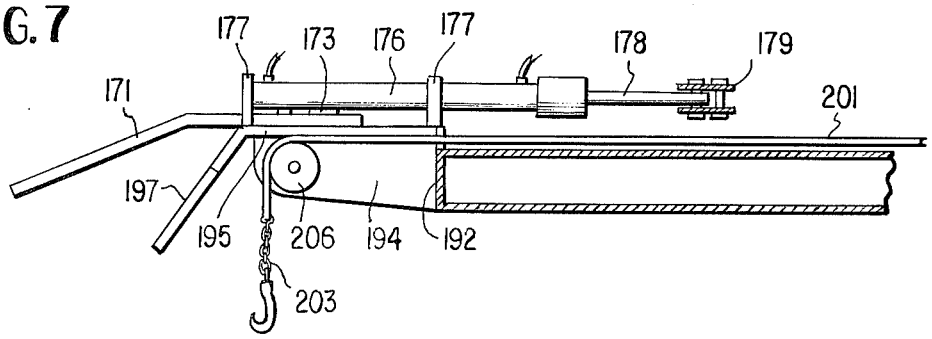
FIG. 7 is a side elevational view, partly in cross section, of a further portion of the arrangement shown in FIG. 2.
Figure 8:
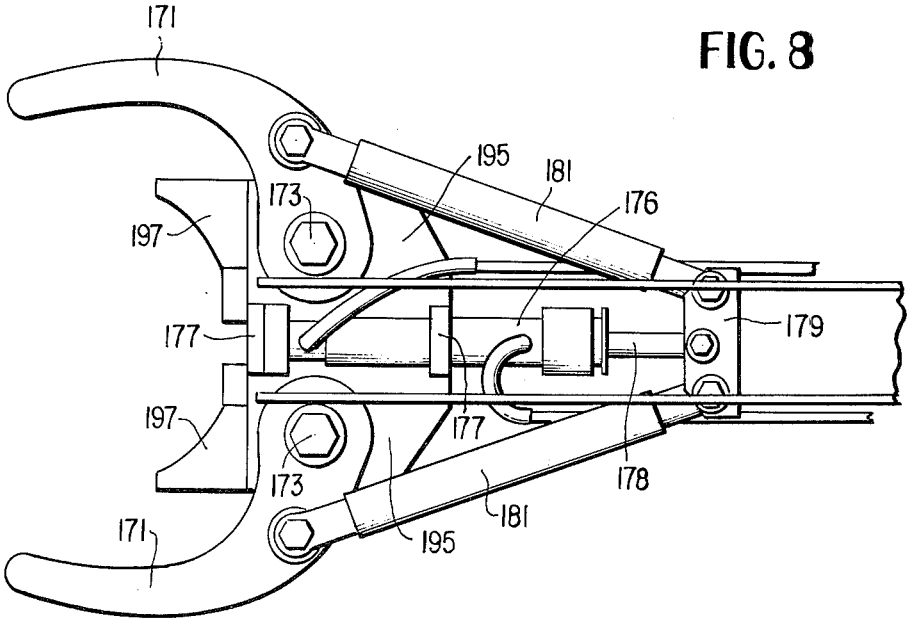
FIG. 8 is a top plan view of the portion shown in FIG. 7, but to an enlarged scale.

In the preferred embodiment of the invention, the boom is equipped with a pole claw and with a cable carrying a chain and hook at its free end. As shown in FIGS. 2, 7 and 8, the pole claw is composed of a pair of limbs 171 pivotally mounted on pivot pins 173 defining pivot axes perpendicular to the length of the upper boom.

The opening and closing movements of limbs 171 are effectuated by a mechanism composed of a piston whose cylinder 176 is fixed to the free end of the upper boom by means of supports 177. The piston rod 178 of the piston is located to extend away from the free end of the boom and carries a yoke 179.

Also connected to the yoke 179, in a pivotal manner, are two rods, or arms, 181 whose other ends are connected, also in a pivotal manner, to a respective one of limbs 171 so that extension of rod 178 opens the pole claw and retraction of rod 178 closes the pole claw. Cylinder 176 is of the double acting type in that it is provided with a pressure fluid inlet at each end, as can be seen in FIGS. 7 and 8, to enable the rod 178 to be positively driven in either direction.

The free end of the upper boom is formed at the end of box member 133 by a bearing plate 192, two parallel support plates 194 extending outwardly, i.e. longitudinally of the boom, from plate 192, and two top plates 195 also extending outwardly from plate 192 and resting atop plates 194. Plates 195 are provided with downwardly extending projections 197 formed to act as pole cradles and located to cooperate with the pole claw.

The cable 201 carrying a chain and hook 203 is stored on a drum 204 mounted on a support attached to plates 131 at the rear end of the upper boom. Cable 201 runs along the top of the upper boom, through a slot in plate 192 and a space between plates 197 and around a pulley 206 rotatably mounted between plates 194.

Drum 204 is driven by a hydraulic motor 206 via a speed reduction gear 208, the motor and reduction gear being mounted on a support plate 209 connected across the rear edges of plates 131. Such a drum, reduction gear and hydraulic motor are commercially available from various manufacturers such as the Ramsey Winch Co. of Tulsa, Okla.

As mentioned previously, a machine constituted by a tractor equipped at its rear end with a backhoe and at its front end with a front-end loaded and further provided, according to the invention, with a load-supporting cab carrying an extendible boom equipped with a pole claw and a cable carrying a chain and hook is particularly suited for performing all the operations involved in the installation of a power line pole or telephone pole. The machine illustrated in FIGS. 1–8 can perform such an operation in the following manner:

Assuming that a telephone pole is to be transported to and installed at a remote location and its base is to be surrounded by select backfill material differing from that available at the installation location, bucket 51 of the front-end loader can be filled with the requisite select backfill material, and the pole and its associated framing hardware can be loaded on the machine at a dispatching location. The boom mounted on housing 101 is brought to its fully lowered position by operating the appropriate ones of levers 113 to retract pistons 141 and 143, thereby giving the machine a low center of gravity.

The machine is then driven to the installation location, taking all requisite material and components in one trip. At the installation site, the backfill material being carried in bucket 51 is deposited to one side of the point at which the pole is to be erected, while the pole itself is laid to the other side of such point.

Then, the operator positions the machine to face away from the installation point, the pole then lying to one side of the machine.

Then, the operator pivots housing 101 about pin 105 by operating the appropriate one of control levers 113 to supply hydraulic fluid to a respective one of pistons 160. At the same time, if necessary, one or both of pistons 141 and 143 are extended, this combination of operations serving to bring chain and hook 203 approximately directly above the pole at a point between its center of gravity and its top.

Thereafter, hydraulic fluid is supplied to hydraulic motor 206 in order to rotate drum 204 in a direction to unwind the cable 201 and lower the chain and hook 203 to the ground. A worker on the ground brings the chain around the pole, at a point above its center of gravity, and engages the hook in an upper link of the chain so that the chain is securely wrapped around the pole.

The operator in the cab then supplies hydraulic fluid to motor 206 so as to rewind cable 201 around drum 204 and thereby lift the top end of the pole to a sufficient height to enable a worker on the ground to mount the requisite framing hardware thereon.

While the hardware is being mounted on the pole by a worker on the ground, the machine operator proceeds to dig the necessary hole, or trench, by means of the backhoe. After the hole has been dug to its proper depth and all of the necessary hardward has been mounted on the top of the pole, the backhoe bucket is moved to one side of the pole erection area by supplying hydraulic fluid to a respective end of piston 85. Then the bucket 71 can be lowered into firm contact with the ground to form, together with outriggers 88 which were previously brought into firm contact with the ground, a three-point support enclosing the point at which the pole is to be erected.

Then, one or both of pistons 141 and 143 are extended to raise the upper boom 131 and 133 sufficiently to bring the pole to a generally vertical orientation and to bring the pole between pole claw limbs 171. After this has been done, hydraulic fluid is supplied to one of the fluid inputs to piston 178 so as to move yoke 179 toward the free end of the upper boom and thus bring limbs 171 toward one another to securely grip the pole. Housing 101 is pivoted about pin 105 by supplying hydraulic fluid to a respective one of pistons 160, while the fluid is also supplied to one or both of pistons 141 and 143 to maneuver the pole into a position in which its bottom end is properly located in the hole and the pole is vertically oriented.

The pole is then held in this position by the pole claw while the backhoe fills the hole around the pole with the select fill material, which is then tamped as required.

Finally, the pole claw is opened and the free end of the upper boom is lowered to slide the chain and hook toward the ground, where the worker can unhook the chain.

While the invention has been described with particular reference to the installation of power line poles and telephone poles, it can be used advantageously in a wide variety of different construction tasks. For example, it could be used to advantage in the installation of underground electric power lines and telephone lines. The machine can also be used advantageously for the installation of sewer, water and gas lines. In these situations, the backhoe can serve to dig the required trench, while the boom with its associated pole claw, cable, chain and hook is employed to lay the cables, pipes or conduits in the trench. The pole claw, chain and hook can also be used in construction projects for placing transformer pads, transformers, reels of cable, etc. On housing projects, at least some of the excavation can be performed by the backhoe, while the boom with its associated equipment can serve to position and hold pre-constructed footings, pilings, walls, beams and roof trusses while they are being secured in place.

The boom mounted atop the cab can be equipped with various types of units in place of the pole claw. To cite one example, it could be provided with a bucket device used to support a person, in which case the boom could serve as a man lift to permit a worker to reach otherwise inaccessible locations.

it will be understood that the above description of the present invention is susceptible to various modifications, changes and adaptations, and the same are intended to be comprehended within the meaning and range of equivalents of the appended claims.

We claim:

1. A mobile, self-contained construction machine comprising, in combination:

an automotive vehicle presenting a support platform and including a cab having a roof arranged to support high level weight loads, said cab defining an enclosure to be occupied by an operator;

a backhoe system supported by said platform and extending from one side of said vehicle, said backhoe system being mounted to said platform for pivotal movement in a horizontal plane relative to said vehicle;

an extendible folding boom including at least two articulated members, and pivotally mounted on said roof of said cab and extending upwardly therefrom;

a pole claw composed of a pair of opposed limbs pivotally mounted at the free end of said boom, and claw operating means connected for pivoting said limbs in directions to respectively open and close said pole claw;

a cable carried by said boom and means at the free end of said boom for guiding the end of said cable so that the end of said cable extends from said guiding means downwardly from the free end of said boom;

a chain and hook connected to the end of said cable; and control means disposed in said cab for use by an operator therein and operatively connected to said backhoe system, said boom and said claw operating means for enabling the operation thereof to be controlled by the operator.

2. A machine as defined in claim 1 wherein said boom comprises: a boom housing mounted on the roof of said cab for pivotal movement with respect thereto about a vertical axis; a lower boom member; an upper boom member; means connecting said lower boom to said housing for pivotal movement about a horizontal axis; and means connecting said upper boom to said lower boom for pivotal movement about a horizontal axis.

3. A machine as defined in claim 1 further comprising: a drum rotatably mounted on said boom and having said cable wound thereon; and means connected to said drum for rotating it and arranged to be controlled by said control means.

4. A machine as defined in claim 1 wherein said backhoe system is mounted at the rear of said vehicle.

5. A machine as defined in claim 4 wherein said control means include manually operable means for controlling said boom and said claw operating means, and supported from the underside of the roof of said cab.

6. A machine as defined in claim 4 wherein said vehicle is wheeled tractor.

7. A machine as defined in claim 6 further including a front-end loader system mounted at the front of said tractor.

* * * * *